United States Patent [19]

Shimoyama

[11] Patent Number: 4,730,780

[45] Date of Patent: Mar. 15, 1988

[54] INK RIBBON CASSETTE

[75] Inventor: Noboru Shimoyama, Yokohama, Japan

[73] Assignee: Canon Kabushiki Kaisha, Tokyo, Japan

[21] Appl. No.: 862,626

[22] Filed: May 13, 1986

[30] Foreign Application Priority Data

May 22, 1985 [JP] Japan ..... 60-109638

[51] Int. Cl.[4] ..... B41J 33/52; B41J 32/00

[52] U.S. Cl. ..... 242/75.45; 242/75.4; 242/67.3 R; 242/199; 400/208

[58] Field of Search ..... 242/45, 67.3 R, 67.5, 242/75, 75.2, 75.3, 75.4, 75.41, 75.45, 75.5, 156.1, 156.2, 197–199; 400/207, 208, 228, 234, 236, 236.1

[56] References Cited

U.S. PATENT DOCUMENTS

| | | | |
|---|---|---|---|
| 3,172,611 | 3/1965 | Harris | 242/75.45 X |
| 3,682,407 | 8/1972 | Lichtenstein et al. | 242/67.3 R |
| 3,880,373 | 4/1975 | Cook | 242/67.3 R |
| 4,013,160 | 3/1977 | Colecchi et al. | 242/75.45 X |
| 4,422,592 | 12/1983 | Swope et al. | 242/75.45 |
| 4,434,950 | 3/1984 | Nunnerich et al. | 242/67.3 X |
| 4,456,193 | 6/1984 | Westover | 242/67.3 X |
| 4,496,255 | 1/1985 | Meintrup et al. | 242/199 X |
| 4,625,930 | 12/1986 | Urlick | 242/67.3 R |

*Primary Examiner*—Donald Watkins

*Attorney, Agent, or Firm*—Fitzpatrick, Cella, Harper & Scinto

[57] ABSTRACT

An ink ribbon cassette includes a case, supply side core rotatably held by the case and having an uneven portion in a portion thereof, an ink ribbon wound on the core, a take-up side core rotatably held by the case to take up the ink ribbon, and a spring resiliently engaged with the uneven portion of the supply side core and resiliently pressing the outer periphery of the ink ribbon wound on the supply side core.

4 Claims, 3 Drawing Figures

INK RIBBON CASSETTE

BACKGROUND OF THE INVENTION

1. Field of the Invention

This invention relates to an ink ribbon cassette in which an ink ribbon drawn out from a supply spool is taken up onto a take-up spool.

2. Related Background Art

Generally, an ink ribbon cassette is such that as the diameter of a supply spool is decreased, the torque with which the ink ribbon on the supply spool is drawn out increases to make it difficult for the ribbon to be stably drawn out.

SUMMARY OF THE INVENTION

The present invention has been made in view of the above-noted disadvantage and an object thereof is to provide an ink ribbon cassette which enables a ribbon to be stably drawn out and which has a reduced number of parts and is simplified in structure.

Other objects of the present invention will become apparent from the following detailed description thereof taken in conjunction with the accompanying drawings.

DESCRIPTION OF THE PREFERRED EMBODIMENT

Figure 1:
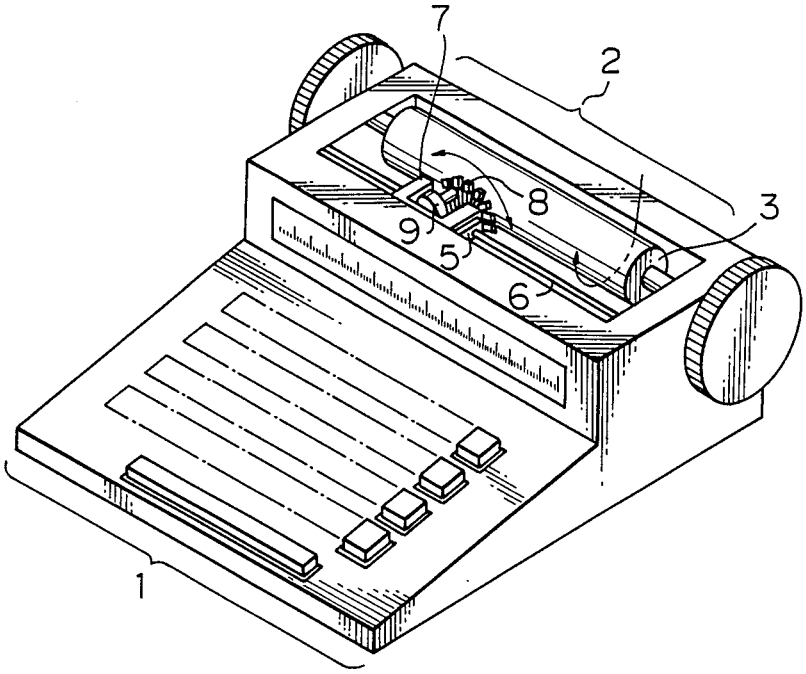
FIG. 1 is a perspective view of a printer in which is mounted an ink ribbon cassette according to an embodiment of the present invention.

A printer in which an ink ribbon cassette 7 is mounted according to an embodiment of the present invention is comprised of an operating unit 1 and a printing mechanism unit 2, as shown in FIG. 1. The printing mechanism unit 2 comprises a platen 3, a printing carriage 5 and a driving portion 6 therefor. A character wheel 8, a printing hammer 9 and the ink ribbon cassette 7 for supplying ink are mounted on the printing carriage 5.

Figure 2:
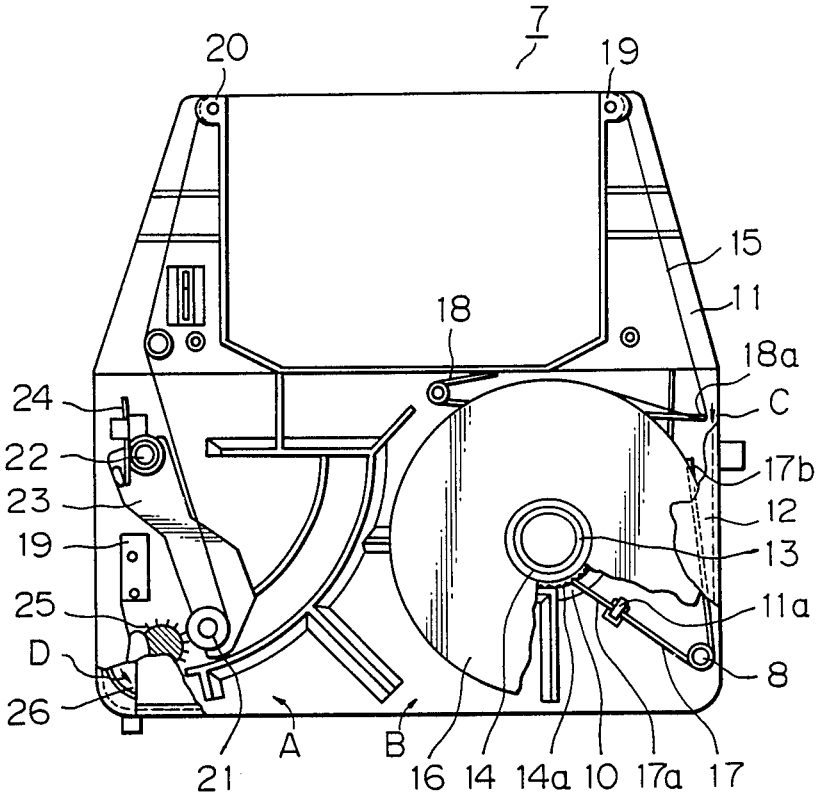
FIG. 2 is an illustration of a partly broken-away plane of the ink ribbon cassette according to an embodiment of the present invention.

FIG. 2 shows the details of the ink ribbon cassette. The cassette is divided into a take-up side A engaged with the printing carriage to take up the ink ribbon and a supply side B for supplying the ink ribbon so as not to interfere with the taking-up and printing operations. The cassette is comprised of a lower case 11 and an upper case 12, and various portions to be described are contained in the space therebetween. A central core 14 is rotatably fitted in a rotating boss 13 provided in the lower case 11, and the ink ribbon 15 is wound on the core 14 to thereby form a supply spool 16. The peripheral surface of that portion of the core 14 which is lower than the portion thereof on which the ink ribbon is wound is formed with a knurled uneven portion 14*a* for controlling the amount of unwinding of the supply spool 16. One arm 17*a* of a detent spring 17 fixed to the lower case 11 by the restraining portion 11*a* thereof is resiliently engaged with the knurled uneven portion 14*a*, and the other arm 17*b* of the detent spring 17 is resiliently urged against the outermost periphery of the ribbon spool 16. The ink ribbon 15 drawn out through such a detent mechanism is further biased by the arm 18*a* of a tension spring 18 for eliminating any slack of the ink ribbon, and is taken up by a take-up core 21 via guides 19 and 20. The take-up core 21 is rotatably provided on the end of a take-up lever 23 pivotable about a shaft 22. The take-up lever 23 is biased by a plate spring 24 toward ribbon feeding teeth 25 rotatably held between the upper case 12 and the lower case 11. Minute needles project around the ribbon feeding teeth 25 and penetrate into the take-up core 21 or the ink ribbon wound on the core 21 and thus, it becomes possible to take up the ink ribbon onto the take-up core 21 by rotating a manually operated knob 26 in the direction of arrow D, the knob 26 being fixed coaxially with the ribbon feeding teeth 25 and partly exposed from the upper case 12. As the ribbon is taken up onto the core 21, the winding diameter of the take up spool is increased.

Figure 3:
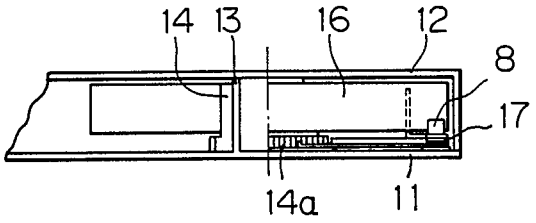
FIG. 3 is a cross-sectional view of a supply side ribbon spool.

FIG. 3 shows a cross-section of the supply spool. As can be seen in this Figure, the uneven portion 14*a* of the central core 14 at the lower end thereof is smaller in diameter than the portion of the central core on which the ribbon is wound and accordingly, the ribbon winding position becomes stable when the ribbon is wound onto this core 14.

In the above-described embodiment, the arm 17*a* of the detent spring 17 is engaged with the knurled uneven portion 14*a* of the core 14 to impart back tention to the ribbon, and further the arm 17*b* presses the peripheral surface of the ribbon spool 16 to impart back tension so as to ensure the ribbon spool 16 to be drawn out with the same torque. Also, back tension is further imparted to the ink ribbon by the tension spring 18.

The present invention is not restricted to the above-described embodiment, but for example, the tension spring 18 may be eliminated. Also, the ink ribbon drawn out toward the guide 19 may be passed over the arm 17*b* of the detent spring, and this arm 17*b* may be used to perform the function of the arm 18*a* of the tension spring 18. Thereby, the number of parts is reduced.

In the present invention, as described above, not only a detent force is imparted to the central core of the supply spool by the detent spring, but also a pressure force is imparted to the peripheral surface of the supply spool, whereby back tension can be effectively imparted to the supply spool by a small number of parts, thus stabilizing the draw-out of the ribbon.

I claim:

1. An ink ribbon cassette including:

a case;

a supply core rotatably held by said case and having a detent portion thereof;

an ink ribbon wound on said supply core, a take-up core rotatably held by said case to take up the ink ribbon; and an elongated spring bent and fixed at its center to have a first free end which is in resilient engagement with the detent portion of said supply core and a second free end which is in resilient contact with the outer periphery of the ink ribbon wound on said supply core, said second free end moving according to the amount of the ink ribbon wound on said supply core to reduce urging force to the ink ribbon and impart to the ink ribbon a substantially constant tension for all amounts of ink ribbon wound on the supply core.

2. An ink ribbon cassette according to claim 1, wherein a tension spring is provided for imparting back tension to the ink ribbon drawn out from said supply core to said take-up core.

3. An ink ribbon cassette according to claim 1, wherein said take-up core is rotatably supported to a free end of a lever which is pivotably held to said case.

4. An ink ribbon cassette according to claim 3, further including:

an ink ribbon advancing member rotatably held to said case to take up the ink ribbon, said lever being biased so that said take-up core is urged to said advancing member.

* * * * *

UNITED STATES PATENT AND TRADEMARK OFFICE

CERTIFICATE OF CORRECTION

PATENT NO. : 4,730,780

DATED : March 15, 1988

INVENTOR(S) : NOBORU SHIMOYAMA, ET AL.

It is certified that error appears in the above-identified patent and that said Letters Patent is hereby corrected as shown below: On the title page:

AT [56] REFERENCES CITED

Line 9, "Urlick" should read --Urlik--.

Column 2

Line 16, "take up" should read --take up--; and

Line 27, "tention" should read --tension--.

Signed and Sealed this

Eighth Day of November, 1988

*Attest:*

*Attesting Officer*

DONALD J. QUIGG

*Commissioner of Patents and Trademarks*